US005931077A

United States Patent [19]

DeYoung

[11] Patent Number: 5,931,077

[45] Date of Patent: Aug. 3, 1999

[54] BRAIDING MACHINE EYELET TUBE SUPPORT AND DRIVE MECHANISM

[76] Inventor: Simon A. DeYoung, 410-32 Meadowview Dr., Aurora, Ohio 44202

[21] Appl. No.: 09/113,409

[22] Filed: Jul. 10, 1998

[51] Int. Cl.[6] ..... D04C 3/02

[52] U.S. Cl. ..... 87/44; 87/38; 87/45; 87/55

[58] Field of Search ..... 87/33, 37, 38, 87/39, 44, 45, 50, 54, 55, 62

[56] References Cited

U.S. PATENT DOCUMENTS

| | | | |
|---|---|---|---|
| 881,475 | 3/1908 | Korting | 87/39 |
| 1,499,830 | 7/1924 | Krissiep | 87/44 |
| 2,148,164 | 2/1939 | Krippendorf | 96/12 |
| 2,788,700 | 4/1957 | Crossley et al. | 87/50 |
| 3,748,952 | 7/1973 | Petzetakis | 87/29 |
| 3,783,736 | 1/1974 | Richardson . | |
| 3,981,223 | 9/1976 | Ostermann | 87/50 |
| 4,034,642 | 7/1977 | Iannucci et al. | 87/48 |
| 4,084,479 | 4/1978 | Ratera | 87/48 |
| 4,158,984 | 6/1979 | Griffiths | 87/44 |
| 4,275,638 | 6/1981 | DeYoung . | |
| 4,913,028 | 4/1990 | Yoshiya | 87/44 |
| 5,085,121 | 2/1992 | Richardson | 87/29 |
| 5,257,571 | 11/1993 | Richarson | 87/50 |
| 5,749,280 | 5/1998 | Scheringer | 87/48 |

FOREIGN PATENT DOCUMENTS

| | | | |
|---|---|---|---|
| 906937 | 2/1946 | France | 87/33 |
| 138069 | 9/1920 | Switzerland | 87/33 |

*Primary Examiner*—William Stryjewski
*Assistant Examiner*—Tejash D Patel
*Attorney, Agent, or Firm*—Vickers, Daniels, & Young

[57] ABSTRACT

A braiding machine comprises a frame, a plurality of rotors on the frame and rotatable about rotor axes arranged about a braiding axis, drive gears for rotating adjacent ones of the rotors in opposite directions, and a plurality of strand shuttles which are driven by the rotors along a sinuous path in a given direction about the braiding axis. Adjacent ones of said rotors have transfer points for sequentially transferring a shuttle from a preceding rotor to a succeeding rotor with respect to the direction of the path, and the rotors and shuttle include interengaging retaining and escapement members by which the shuttle is moved with the preceding rotor toward the transfer point and then with the succeeding rotor away from the transfer point. A shuttle cam extends about the braiding axis, and cam follower rollers on the shuttle engage the cam for controlling the angular position of the shuttle relative to the preceding and succeeding rotors as the rotors move the shuttle through the transfer point therebetween.

36 Claims, 10 Drawing Sheets

BRAIDING MACHINE EYELET TUBE SUPPORT AND DRIVE MECHANISM

BACKGROUND OF THE INVENTION

The present invention relates to the art of braiding machines and, more particularly, to an improved arrangement for supporting and transporting strand eyelet tubes along a sinuous path about a braiding axis.

Braiding machines are of course well known and are used, for example, to braid strands of materials such as steel, stainless steel, bronze, polyester, nylon, arramed, carbon fibers, and the like around a tubular substrate such as a flexible tube in connection with producing high pressure hydraulic or other types of pressure resisting hose. The braiding machines can also be used to braid many other products such as sewing threads, sutures, fishing line, ropes of many types, fashion textiles, cables for electrical and electronic use, lifting cables, and many other such products.

One type of braiding machine used for producing products of the foregoing character is known as a maypole or horn gear type braider such as that shown in U.S. Pat. No. 3,783,736 to Richardson, the disclosure of which is hereby incorporated herein by reference for background purposes. In machines of the latter type, bobbin or strand carriers are moved by horn gears or notched rotors along sinuous paths around the braiding point or axis. Adjacent ones of the rotors rotate in opposite directions, whereby half of the carriers move along a sinuous path in one direction about the braiding axis while the other half of the carriers move along a sinuous path in the opposite direction. Each path runs radially inwardly and outwardly of the braiding axis and the two paths cross one another at each alternating direction, whereby the strands leaving the bobbins are interwoven as they converge to the braiding point. Such horn gear type braiding machines are limited in speed due to structural complexity and sliding friction between the component parts thereof and are subject to frequent and costly maintenance as a result of the number and structural interrelationship between the component parts. Moreover, machines of this type are structurally complex and require a high level of precision with respect to the manufacturing of the parts and the obtaining and maintaining of alignment and other structural interrelationships therebetween, whereby manufacturing costs are undesirably high as are the time and expense of maintenance required to maintain the high level of precision. Moreover, the restricted braiding speed reduces production rate and, thus, increases the cost of production.

Another type of braiding machine used for the production of products of the foregoing character is a rotary braiding machine such as that shown in my U.S. Pat. No. 4,275,638 issued Jun. 30, 1981 and the disclosure of which is hereby incorporated herein by reference for background purposes. In a machine of the rotary type, there are axially spaced sets of inner and outer bobbin carriers which are rotated about the braiding point or axis in opposite directions, and a set of strand deflectors located between the carrier sets which cause the strands from one of the carrier sets to cross the path of the other, thus interweaving the strands. In my aforementioned patent, the strands from one set of bobbin carriers are guided axially past the other set of bobbin carriers by individual elongated eyelet tubes which are supported axially between the two carrier sets and driven along a sinuous path about the braiding point and across the path of the strands of the other set of bobbin carriers to achieve the interweaving of the strands about the braiding axis. The eyelet tubes have three axially spaced apart support points adjacent one end thereof, whereby undesirable forces can be imposed on the eyelet tubes during the driving thereof along the sinuous path about the braiding axis. Accordingly, manufacturing precision is required in an effort to minimize the imposition of such forces while, at the same time, providing the necessary stability with respect to supporting the eyelet tubes as they are driven along the sinuous path about the braiding axis. Moreover, even with such control in connection with manufacturing the component parts, braiding speed of the machine is restricted. The forces imposed on the eyelet tube and other component parts of the drive therefore are both radial and sliding frictional forces. The latter results from parts of the drive arrangement being fixed and sliding displacement of the eyelet tubes relative thereto, and the radial forces can impose bending loads on the eyelet tubes as a result of the three axially spaced points of engagement of the eyelet tubes with the support and drive components. Precision in manufacturing increases both manufacturing and maintenance costs, and restricted braiding speed reduces production rate and, accordingly, increases the cost of production.

The improvement according to the present invention is illustrated and described herein in conjunction with the braiding machine disclosed in my aforementioned patent but, as will become apparent in connection with the disclosure herein, the invention is equally applicable to horn gear type braiding machines.

SUMMARY OF THE INVENTION

In accordance with the present invention, each strand of at least one set of strands to be moved along a sinuous path about a braiding axis is supported for such movement by a shuttle component which is transported along the path by a plurality of rotors arranged in a circular pattern about the braiding axis and mounted on the machine for rotation about corresponding rotor axes. The rotors and shuttles are structured and structurally interrelated in a manner which minimizes the imposition of undesirable forces therebetween, eliminates the potential of imposing bending forces against the shuttles and eyelet tubes supported thereby and eliminates sliding frictional forces therebetween. Accordingly, an appreciably higher braiding speed and thus a higher production rate is obtainable than with braiding machines heretofore available. Moreover, the rotors and shuttles are structurally simple, whereby production and maintenance costs are reduced.

In accordance with one aspect of the invention, a shuttle is interengaged with a rotor for rotation therewith about a rotor axis by interengaging retainer and escapement components respectively on the rotor and shuttle. A cam track extends about the braiding axis, and a follower arrangement on the shuttle engages the cam track to relatively position the shuttle and the rotors such that the shuttle is transferred from a preceding to a succeeding rotor with respect to the direction of the path. More particularly in this respect, interengagement between the cam track and follower at the transfer point between adjacent rotors operates to release the escapement component on the shuttle from the retainer component on the preceding rotor while engaging another escapement component on the shuttle with a retainer component on the succeeding rotor.

In accordance with another aspect of the invention, each of the rotors is provided with a corresponding drive gear axially spaced therefrom and the drive gears of the rotors are in meshing interengagement with one another, whereby rotation of one of the drive gears imparts rotation to the others for adjacent ones of the gears and thus the corresponding adjacent rotors to rotate in opposite directions relative to one another. Each shuttle extends axially between a rotor and its drive gear, and the drive gears and shuttles are provided with interengaging retainer and escapement components which, in the manner described above, interengage for the shuttle to rotate with a rotor and its drive gear. Likewise, as described above, the escapement component on the shuttle disengages the retainer component on a preceding gear and another escapement component engages the retaining component on the succeeding gear at the point of transfer of the shuttle therebetween. Accordingly, the shuttle and an eyelet tube supported thereby is stabilized at the two axially spaced points defined by the rotor and its drive gear with no sliding frictional force therebetween and without the potential for applying a bending force thereagainst.

Preferably, the follower arrangement on the shuttles and the shuttle retaining components on the rotors and gears are roller elements respectively in rolling engagement with the cam track and flanges on the shuttles which provide the escapement components. This arrangement advantageously reduces wearing interengagement between the component parts, thus optimize the life thereof and minimizing downtime for maintenance or replacement of worn parts.

It is accordingly an outstanding object of the present invention to provide an improved drive arrangement for transporting a strand along a sinuous path about the braiding point or axis of a braiding machine.

Another object is the provision of a drive arrangement of the foregoing character which minimizes the imposition of undesirable forces against and between the component parts thereof.

A further object is the provision of a drive arrangement of the foregoing character which enables operation of a braiding machine at a higher braiding speed than heretofore possible.

Yet another object is the provision of a drive arrangement of the foregoing character in which the component parts are structurally simple and structurally interrelated in a manner which minimizes wear therebetween so as to optimize the life thereof and reduce downtime for maintenance or replacement of worn parts.

Still, a further object is the provision of a drive arrangement of the foregoing character wherein a strand to be moved along the sinuous path is supported by a shuttle which is moved along the path by a plurality of rotors arranged circumferentially about the braiding axis and wherein the shuttle and rotors are structured and structurally interrelated for a shuttle to rotate with and to be transferred from a preceding to a succeeding rotor in the direction of the path efficiently and with minimal frictional engagement therebetween, thus to promote a longer life for the component parts while enabling a higher speed operation of the machine than heretofore possible.

Still another object is the provision of a drive arrangement of the foregoing character in which each rotor is rotated by a corresponding drive gear and wherein each rotor and drive gear and each shuttle have interengaging retainer and escapement component to stabilize the shuttle during movement thereof along the sinuous path and to achieve such movement with minimal forces against the component parts of the drive arrangement.

Another object is the provision of a drive arrangement of the foregoing character wherein the position of a shuttle relative to a given rotor is controlled by interengaging retainer and escapement components respectively on the rotor and shuttle, a cam track extending about the braiding axis and having a portion extending partially about each rotor axis, and a cam follower arrangement on the shuttle engaging the cam track in a manner whereby a shuttle engages and rotates with a rotor about its axis toward a succeeding rotor along the path and is released from the one rotor and engaged with the succeeding rotor at the point of transfer therebetween for movement with the succeeding rotor about its axis.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 1 is a sectional elevation view somewhat schematically illustrating the lower part of a rotary braiding machine incorporating a strand eyelet tube drive arrangement according to the present invention;

DESCRIPTION OF A PREFERRED EMBODIMENT

Figure 5A:
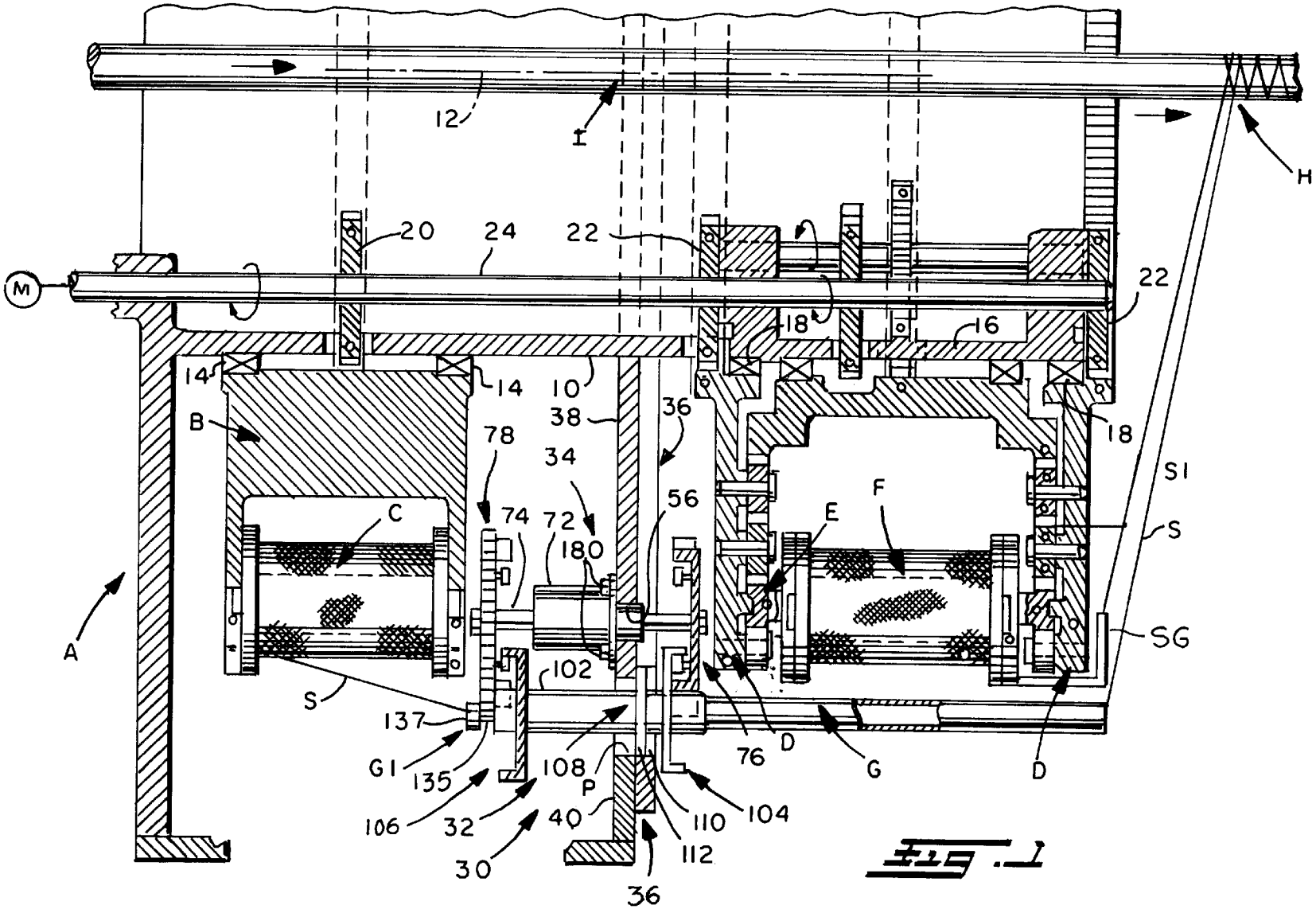
FIG. 5 is a sectional elevation view of the rotor taken along line 5—5 in FIG. 4.

With reference now to the drawings, wherein the showings are for the purpose of illustrating a preferred embodiment of the invention only and not for the purpose of limiting the invention, FIG. 1 illustrates the lower portion of a rotary braiding machine and corresponds to FIG. 1 in my aforementioned patent modified to incorporate a strand eyelet drive arrangement in accordance with the present invention. Accordingly, reference can be had to my earlier patent for greater detail regarding the structure and operation of the machine which is basically the same except for the eyelet drive arrangement. Briefly, the machine comprises a frame A, an outer carrier B supporting a plurality of strand holding bobbins C, an inner carrier comprising a pair of axially spaced plates D and a plurality of pairs of bobbin support members E, each pair supporting a strand bobbin F therebetween. A plurality of eyelet tubes G extend from adjacent outer carrier B axially past the inner carrier and receive strands S from bobbins C on carrier B. Strands S emerge from the right-hand ends of eyelet tubes G and converge on a braiding point H which in the illustrated embodiment is the outer surface of a tubular member I which moves axially from left to right through the braiding machine. Strand guides SG guide strands S1 from each of the bobbins F for the latter strands to converge on braiding point H.

In operation, the bobbin carriers rotate in opposite directions about the braiding point, and eyelet tubes G are driven about the braiding point along a sinuous path moving strands S radially inwardly and outwardly and circumferentially relative to strands S1 so as to move strands S over and under the strands S1 so that the strands are braided at the braiding point H. Bobbin carrier B and the carrier defined by support plates D as well as the bobbin support members E are adapted to be driven in the manner described in my aforementioned patent, although the drive train may be different in some respects from that shown in the patent. In particular, as will become apparent hereinafter, the eyelet tube drive arrangement shown in the patent is eliminated and replaced by the drive arrangement according to the present invention which is described in detail hereinafter. As in my earlier patent, fame A includes a cylindrical frame member 10 having an axis 12 with respect to which tubular member I is coaxial and which accordingly provides a braiding axis with respect to braiding point H. Accordingly, it will be appreciated that reference herein to one of the braiding point and braiding axis is synonymous with the other. Bobbin carrier B is supported for rotation on frame member 10 by bearings 14, and frame member 10 includes a coaxial portion 16 on which carrier support plates D are rotatably mounted by bearings 18. Carrier B and carrier plates D are respectively rotated by a gear 20 and a pair of gears 22 mounted on a shaft 24 which is adapted to be driven by a motor M. Basically, the outer and inner bobbin carriers are structured, supported and driven as shown and described in my aforementioned patent, whereby reference may be had to the latter patent for details in this respect.

Figure 2:
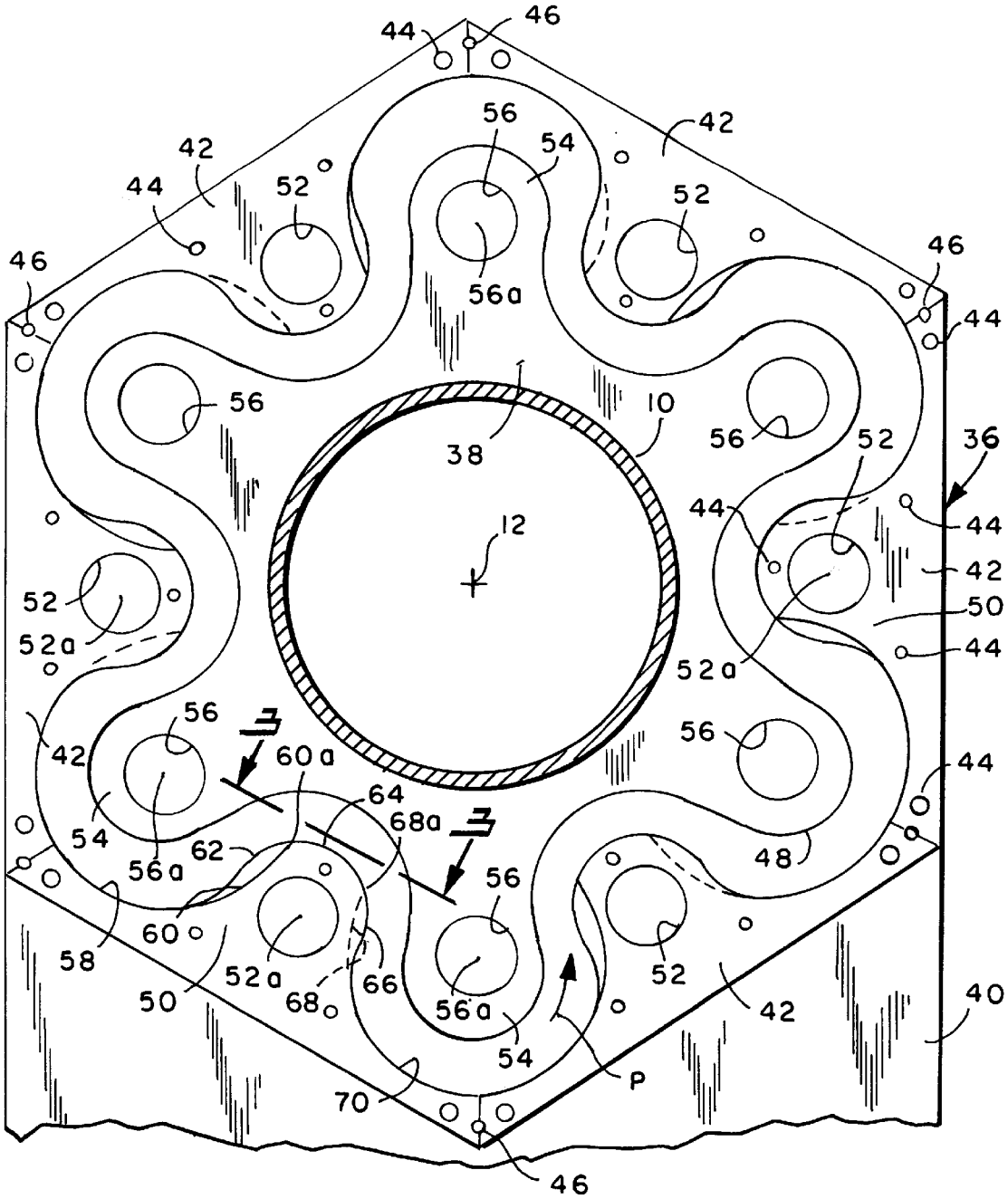
FIG. 2 is an elevation view of the cam track and rotor support frame plates of the braiding machine without the rotors and shuttles mounted thereon.

In accordance with the present invention, an improved support and drive arrangement is provided for moving eyelet tubes G about braiding point H and along a sinuous path which moves strands S radially inwardly and outwardly and across and under strands S1 so that the strands S and S1 are braided at braiding point H. The improved drive arrangement is designated generally by the numeral 30 in FIG. 1 and comprises a plurality of eyelet tube shuttles 32, a corresponding plurality of rotor and drive gear units 34, and a control cam 36. As will become apparent hereinafter, alternate ones of the rotor and drive gear units 34 are mounted on an inner frame or support plate 38 extending about and suitably secured to cylindrical frame member 10, such as by welding, and the ones of the rotor and drive gear units 34 alternating with those on plate 38 are mounted on a frame plate 40 extending about plate 38 in radially outwardly spaced relationship thereto. More particularly with regard to the cam and frame plate structure, which is best illustrated in FIG. 2, control cam 36 is defined by a plurality of identical cam segments 42 mounted on outer frame plate 40 by a plurality of machine bolts 44. Preferably, the ends of adjacent segments 42 abut one another and are recessed to provide a circular opening therebetween which receives a dowel 46 on plate 40 by which the segments are accurately aligned relative to one another. Each of the segments has a cam surface which is described in greater detail hereinafter, and the cam surfaces of the several cam segments together provide a serpentine or sinuous cam track extending about the machine or braiding axis 12. Inner frame plate 38 is cut to provide an outer surface 48 which corresponds generally to the contour of the cam track, and frame plate 40 is cut to provide an opening therethrough which generally corresponds to the contour of the cam track. Surface 48 is spaced radially inwardly of the cam track to provide a sinuous path P therewith which extends about the braiding point or axis. Each of the cam segments includes a lobe 50 extending radially inwardly with respect to machine axis 12, and each lobe includes an opening 52 for receiving the bearing housing of a rotor and drive gear unit mounted on plate 40 therebehind as set forth more fully hereinafter. Plate 38 includes a plurality of lobes 54 extending radially outwardly of axis 12 between adjacent ones of the lobes 50, and each of the lobes 54 includes an opening 56 therethrough for the bearing housing of a rotor and drive gear unit mounted thereon. In the embodiment illustrated, there are a total of twelve lobes 50 and 54, and it will be appreciated that the axes 52*a* of openings 52 and 56*a* of openings 56 are equally radially spaced from axis 12 and are equally spaced apart circumferentially thereabout.

Figure 3:
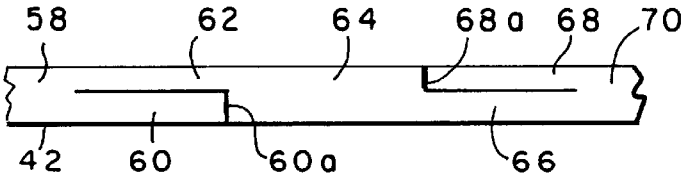
FIG. 3 is a plan view of a portion of a cam trade segment looking in the direction of line 3—3 in FIG. 2.

As best seen in FIGS. 2 and 3 of the drawing, and with respect to the counterclockwise direction of path P shown in FIG. 2, the cam surface of each cam segment 42 has an entrance portion 58, first and second entrance ramp portions 60 and 62, respectively, a crown portion 64, first and second exit ramp portions 66 and 68, respectively, and an exit portion 70. Entrance portion 58 and first entrance ramp 60 have a uniform radius of curvature with respect to axis 56*a* of opening 56 through lobe 54 adjacent the entrance end of the cam segment, and exit portion 70 and second exit ramp 68 have a uniform radius of curvature with respect to axis 56*a* of opening 56 through lobe 54 adjacent the exit end of the cam segment. Second entrance ramp 62, crown portion 64 and first exit ramp 66 have a uniform radius of curvature with respect to axis 52*a* of opening 52 in lobe 50 of the cam segment, and the lower or radially outwardly extending ends of second entrance ramp 62 and first exit ramp 66 are contoured to smoothly merge into the corresponding one of the arcuate entrance and exit portions 58 and 70. As will be appreciated from FIG. 3, and for the purpose which will become apparent hereinafter, first entrance ramp 60 and second exit ramp 68 are axially offset with respect to one another, whereby second entrance ramp 62 and first exit ramp 66 are likewise axially offset with respect to one another. The contours of ramps 60 and 68 provide for first entrance ramp 60 to abruptly intersect crown portion 64 along a line 60*a* defining the exit end of ramp 60 and for second exit ramp 68 to abruptly intersect crown portion 64 along a line 68*a* defining the entrance end of ramp 68. The cam surface of each of the cam segments 42 is identical, whereby it will be appreciated that the foregoing structure and structural interrelationship between the cam surface portions are applicable to each of the cam segments with respect to the direction of path P shown in FIG. 2.

Figure 5:
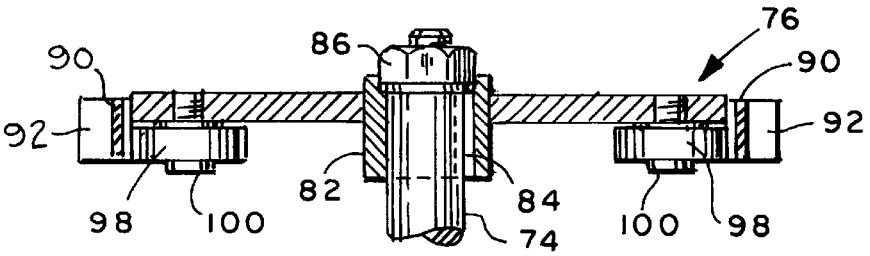
Figure 4:
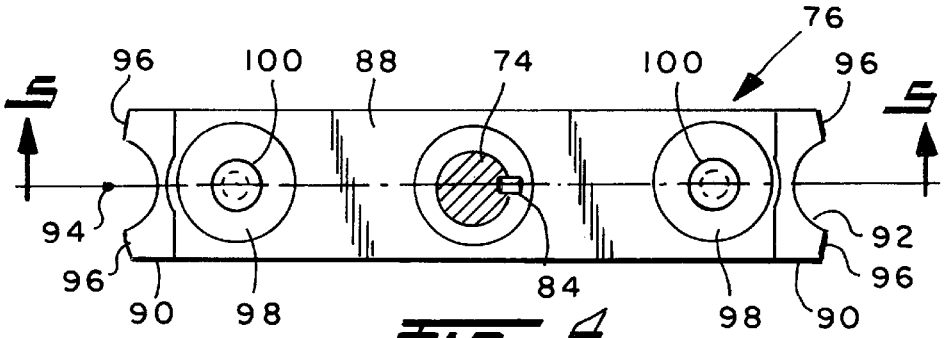
FIG. 4 is an elevation view of a rotor in accordance with the invention.

As will be appreciated from FIG. 1, each of the rotor and drive gear units 34 comprises a bearing housing 72 which rotatably supports a shaft 74 having a rotor 76 mounted on one end thereof for rotation therewith and a drive gear 78 mounted on the other end thereof for rotating the shaft as set forth more fully hereinafter. Rotor and drive gear units 34 are mounted on the inner or rear sides of frame plates 38 and 40 and in this respect, as will be appreciated from the unit 34 shown mounted on plate 38 in FIG. 1, the rotor and drive gear units include a front portion and flange, not designated numerically, respectively extending through an opening 56 and engaging behind the frame plate, and the unit is secured thereto such as by a plurality of machine bolts 80 extending through openings therefor in the flange. As best seen in FIGS. 4 and 5, each of the rotors 76 includes an apertured hub 82 receiving the corresponding end of shaft 74. A key 84 interengages the rotor and shaft for the rotor to rotate with the latter, and the rotor is axially retained on the shaft by means of a nut 86 on the threaded outer end of the shaft. Rotor 76 further includes a rotor arm 88 welded or otherwise secured to hub 82 and extending tnansverse to the rotor axis as defined by the axis of shaft 74. Arm 88 has axially outer and inner sides with respect to the outer end of shaft 74, and the radially outer ends of the rotor arm are defined by support blocks 90 extending axially inwardly of the inner side of the arm and having diametrically opposed, outwardly open C-shaped recesses 92 therein. As will become apparent and described in greater detail hereinafter, recesses 92 are adapted to operatively interengage with the shuttles of the machine to transport the latter along path P about braiding axis 12. Recesses 92 are of uniform radius with respect to a centerline 94 parallel to the axis of shaft 74 and, for the purpose set forth hereinafter, the recesses have an angular extent of slightly less than 180° and the radially outer ends of the rotor arm are defined by surfaces 96 extending laterally outwardly from recesses 92 and inclined radially inwardly of the rotor arm at an angle of about 10° relative to a plane through centerline 94 which is transverse to a line bisecting recesses 92. Also for the purpose which will be described in detail hereinafter, the axially inner side of rotor arm 88 is provided radially inwardly adjacent each of the recesses 92 with a shuttle retaining roller 98. Rollers 98 are preferably of steel and are rotatably mounted on the rotor arm by headed axle bolts 100 having shanks threadedly interengaged with openings therefor in the rotor arm, whereby each roller is rotatable about a roller axis provided by the corresponding axle bolt.

As will be appreciated from FIGS. 1 and 6–8 of the drawing, each eyelet shuttle unit 32 includes a tubular body member 102 which is circular in cross section, has an axis 103, and receives a corresponding eyelet tube G. Each shuttle unit further includes escapement arms 104 and 106 axially inwardly adjacent the opposite ends of the body member and a control arm 108 axially inwardly adjacent the escapement arm 104. As will be appreciated from FIG. 1, body member 102 extends through the radial space between the inner and outer frame plates 38 and 40, escapement arms 104 and 106 are axially adjacent rotors 76 and drive gears 78, respectively, and control arm 108 includes a pair of axially offset follower rollers 110 and 112 which engage the cam track of control cam 36. In the manner described more fully hereinafter, the escapement arms and control arm operatively interengage with the rotors, drive gears and control cam to support and transport the shuttles about path P.

Figure 6:
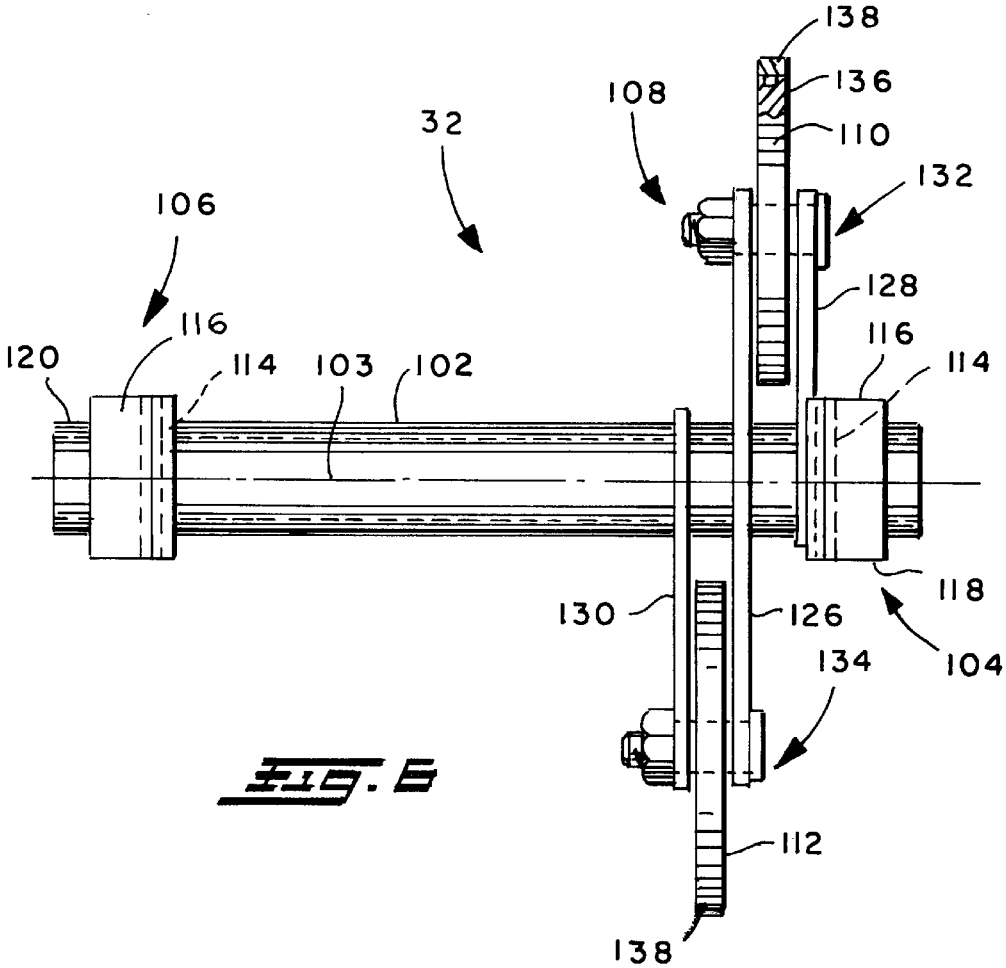
FIG. 6 is a plan view of a shuttle in accordance with the invention.
Figure 7:
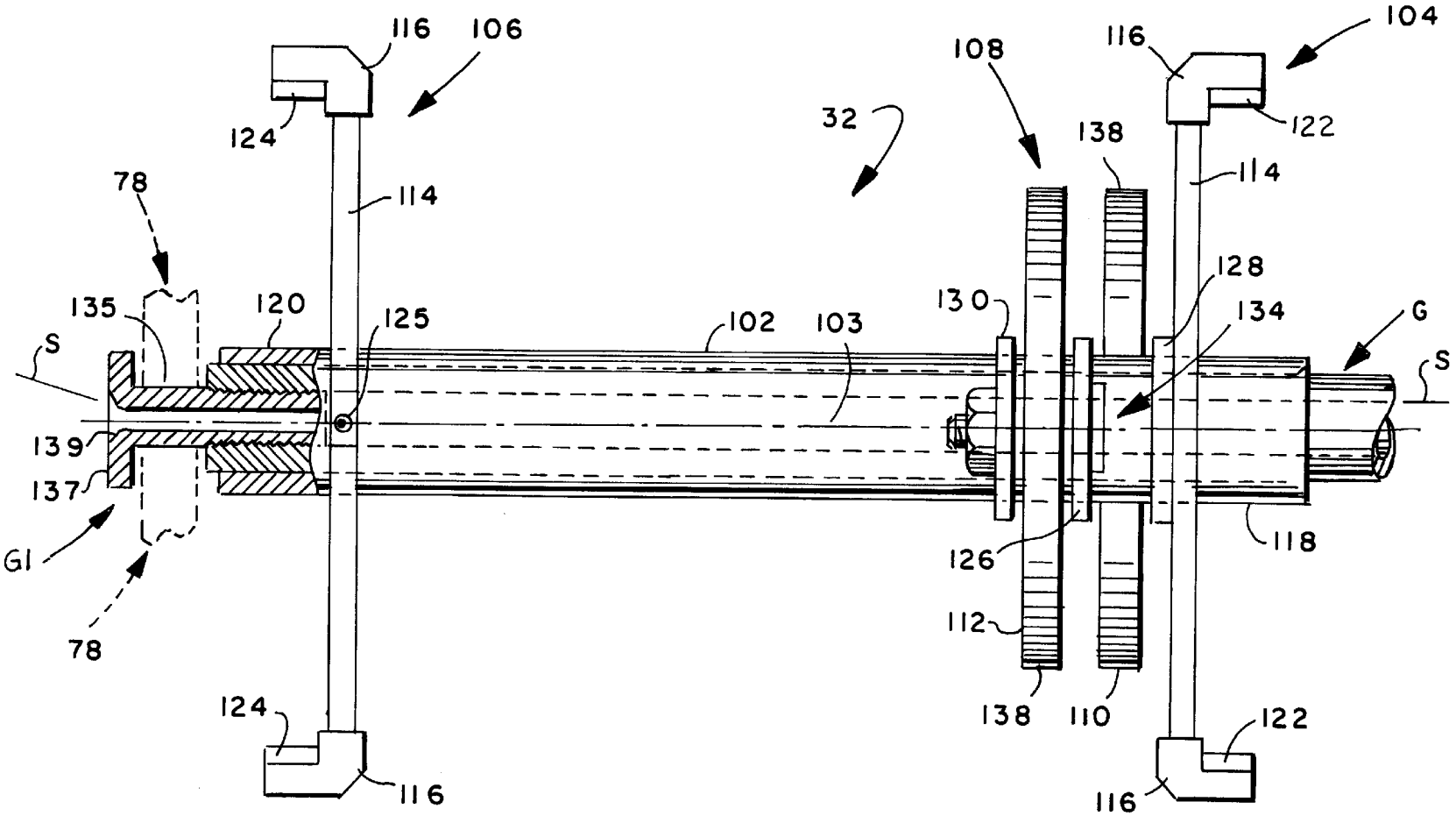
FIG. 7 is a side elevation view of the shuttle and shows the eyelet tube mounted therein and the eyelet tube extension.
Figure 8:
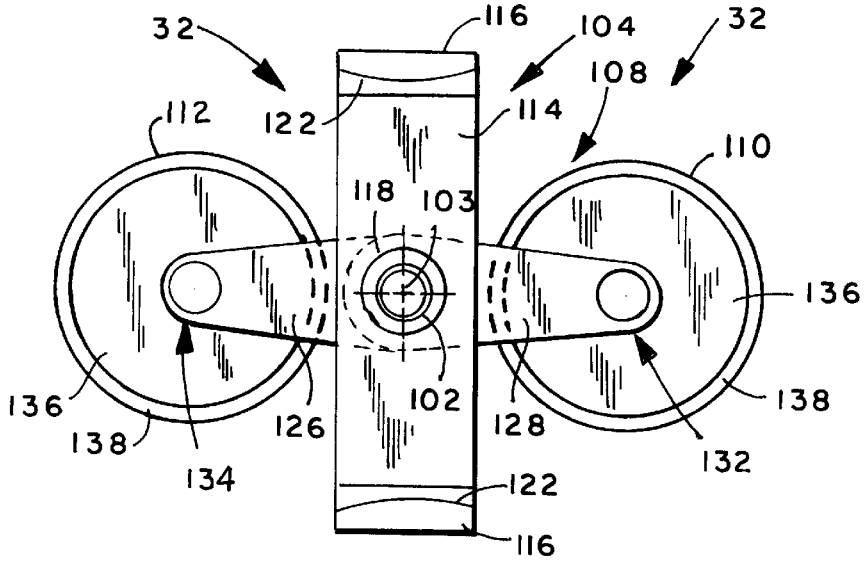
FIG. 8 is an end elevation view of the shuttle looking in the direction from right to left in FIG. 7.

As best seen in FIGS. 6–8, each of the escapement arms 104 and 106 includes an arm plate 114 apertured to receive body member 102 and mounted thereon such as by welding. Arms 114 extend transverse to axis 103 and are in alignment with one another in the direction between the opposite ends of the body member. The radially outer ends of each arm are provided with an escapement cam 116 secured thereto such as by welding and extending axially outwardly therefrom with respect to the corresponding end of the body member. Each of the arm members 114 is spaced axially inwardly of the corresponding end of body member 102 to provide a rotor engaging surface 118 at the end on which escapement arm 104 is mounted and a drive gear engaging surface 120 at the end on which escapement arm 106 is mounted. Escapement cam blocks 116 of escapement arm 104 are provided with diametrically opposed arcuate escapement cam surfaces 122 which are convex relative to rotor engaging surface 118, and escapement cam blocks 116 of escapement arm 106 are provided with diametrically opposed arcuate escapement cam surfaces 124 which are convex with respect to drive gear engaging surface 120 of the body member. As will be appreciated from FIG. 7, the diametrically opposite sides of arm member 114 of escapement arm 106 are provided with threaded apertures therethrough and through body member 102 to receive set screws 125 by which eyelet tube G is mounted on the shuttle against displacement relative thereto.

Control arm 108 is axially inwardly adjacent escapement arm 104 and is transverse to axis 103 and orthogonal with respect to escapement arms 104 and 106. The control arm provides for follower rollers 110 and 112 to be axially offset from one another for the reason set forth hereinafter, and the mounting arrangement for this purpose includes a mounting arm 126 welded on body member 102 and common to both follower rollers, and arms 128 and 130 welded on body member 102 on axially opposite sides of arm 126 and extending outwardly in laterally opposite directions from the body member. Follower roller 110 is received between arm 128 and the corresponding portion of arm 126 and is rotatably mounted thereon by an axle bolt and nut assembly 132, and follower roller 112 is received between arm 130 and the corresponding portion of arm 126 and is rotatably mounted thereon by an axle bolt and nut assembly 134. Preferably, as best seen in FIG. 6 in connection with follower roller 110 and in FIG. 8, each of the follower rollers comprises a hub 136 of aluminum and a tire or thread 138 of molded polyurethane mounted on the outer periphery thereof. The axial offset between follower rollers 110 and 112 provides for roller 110 to engage and roll along first entrance ramp 60 and first exit ramp 66, and for roller 112 to engage and roll along second entrance ramp 62 and second exit ramp 68 to control the corresponding shuttle in the manner and for the purpose set forth more fully hereinafter.

As will be appreciated from FIGS. 1 and 7 of the drawing, each eyelet tube G terminates axially outwardly of escapement arm 106 adjacent the sides of drive gears 78 facing bearing housings 72 of the rotor and drive gear units 34 and include a tubular eyelet extension G1 which, in the manner set forth more fully hereinafter, axially spans the drive gears and provides an inlet to the eyelet tube for the corresponding strand S. Each tubular eyelet extension includes a tubular shank 135 having an inner end threadedly interengaged with a threaded bore provided therefor in the end of the eyelet tube, an unthreaded intermediate portion having an axial length slightly greater than the thickness of drive gears 78, and an outer end in the form of a radially outwardly extending flange 137 which facilitates screwing the extension into and out of engagement with the eyelet tube. While not shown, flange 137 can have peripheral flats to accommodate a wrench or other tool for rotating the extension. Preferably, the entrance end 139 of the eyelet extension is rounded to accommodate the movement of strand S thereacross.

Figure 10:
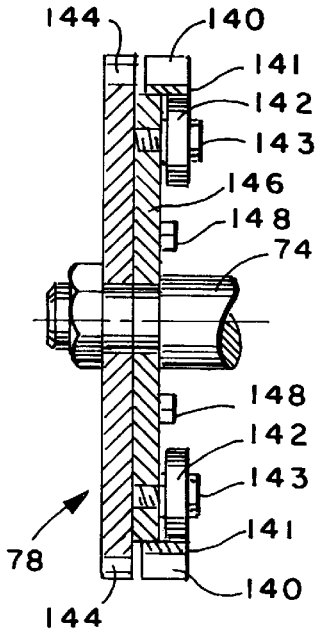
FIG. 10 is a sectional elevation view of the drive gear and shuttle retaining components taken along line 10—10 in FIG. 9.
Figure 9:
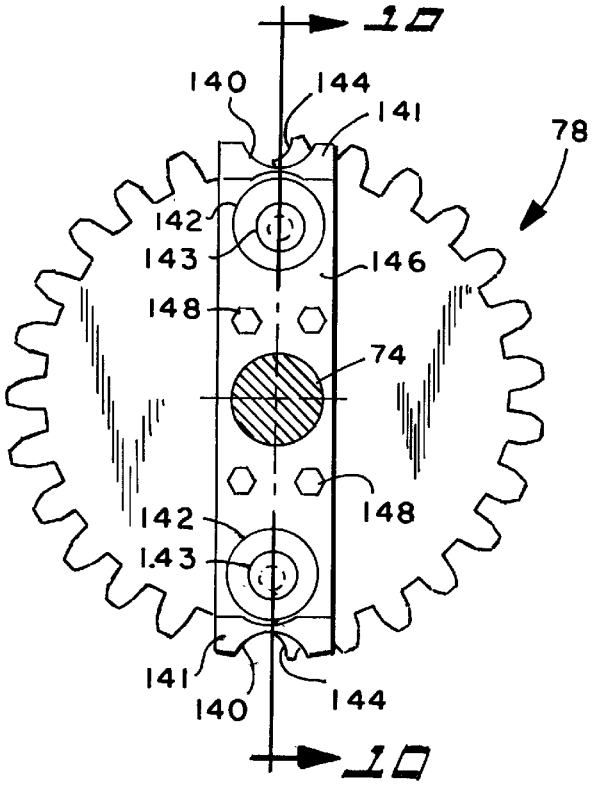
FIG. 9 is an elevation view of a drive gear and shuttle retaining components.

Referring now to FIGS. 9 and 10 of the drawing, the side of each drive gear 78 facing bearing housing 72 of the corresponding rotor and drive gear unit is provided with diametrically opposed outwardly open arcuate shuttle engaging recesses 140 and a shuttle retaining roller 142 axially inwardly adjacent each of the surfaces 140. Surfaces 140 and rollers 142 correspond in contour, dimension and function to recesses 92 and rollers 98 of rotors 76. Further, surfaces 140 and rollers 142 are in alignment axially of the rotor and drive gear unit with the recesses 92 and rollers 98 of the corresponding rotor. As will become apparent and described in greater detail hereinafter, recesses 92 and 140 and rollers 98 and 142 are adapted to operatively interengage respectively with rotor engaging surface 118 and escapement arm 104 and with drive gear engaging surface 120 and escapement arm 106 of a shuttle unit 32 in connection with transporting the latter along path P and about the braiding axis of the machine. For the purpose set forth hereinafter, the teeth of drive gear 78 aligned with the diametrically opposed surfaces 140 are partially cut away radially and circumferentially to provide recesses 144 therein. Surfaces 140 and rollers 142 can be provided on gears 78 in any desired manner and, in the embodiment illustrated, are shown as a unitary component in the form of an apertured arm 146 similar to rotor arm 88 and which is received on shaft 74 and secured to gear 78 by threaded fasteners 148. Surfaces 140 can be provided in support blocks 141 similar to blocks 90 on rotor arm 88, and retaining rollers 142 can be mounted on arm 146 by headed axle bolts 143 corresponding to axle bolts 100 on the rotor arm.

Figure 11:
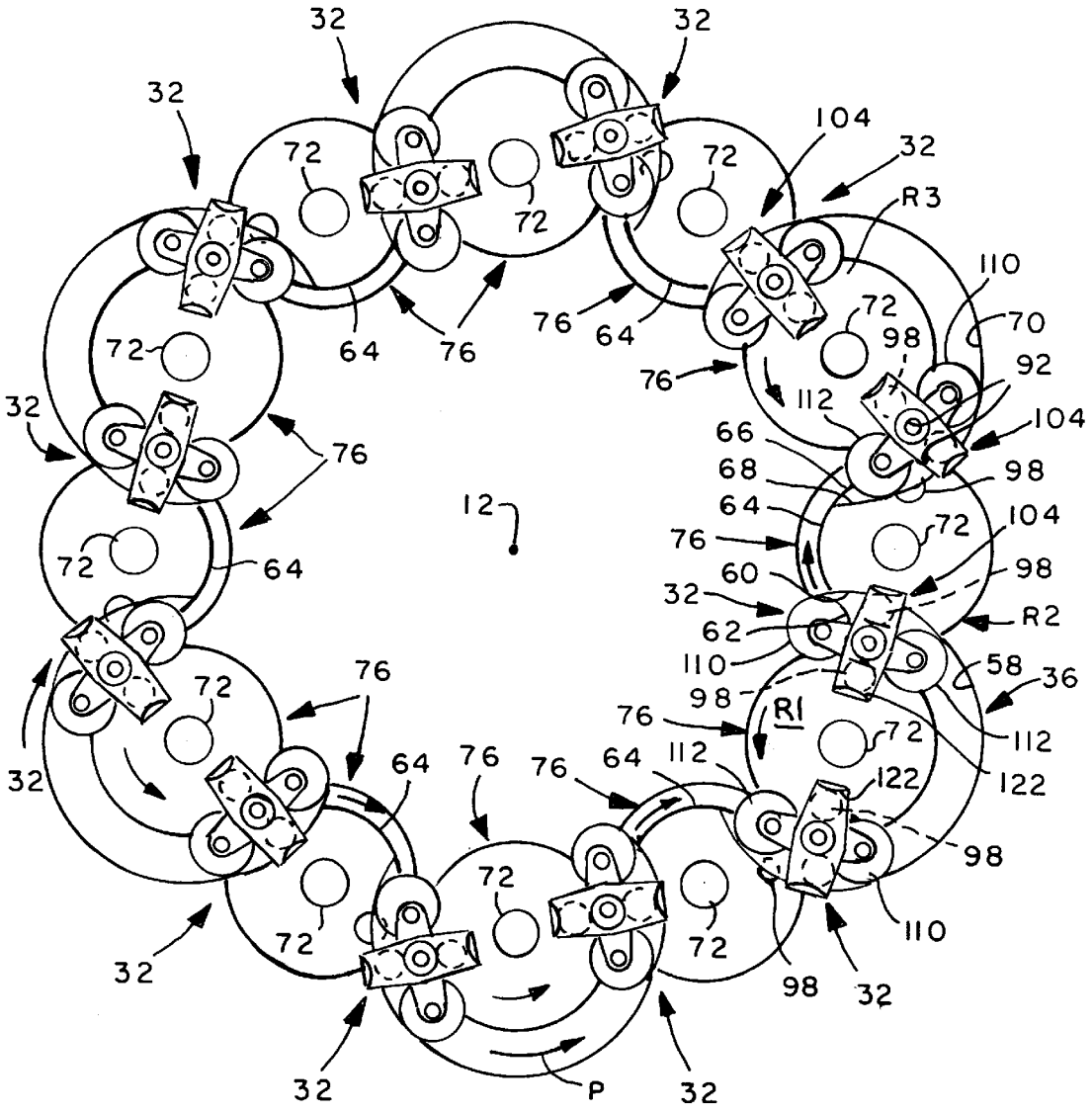
FIG. 11 is a schematic illustration of the circular array of rotors, the control cam and the shuttles.
Figure 12:
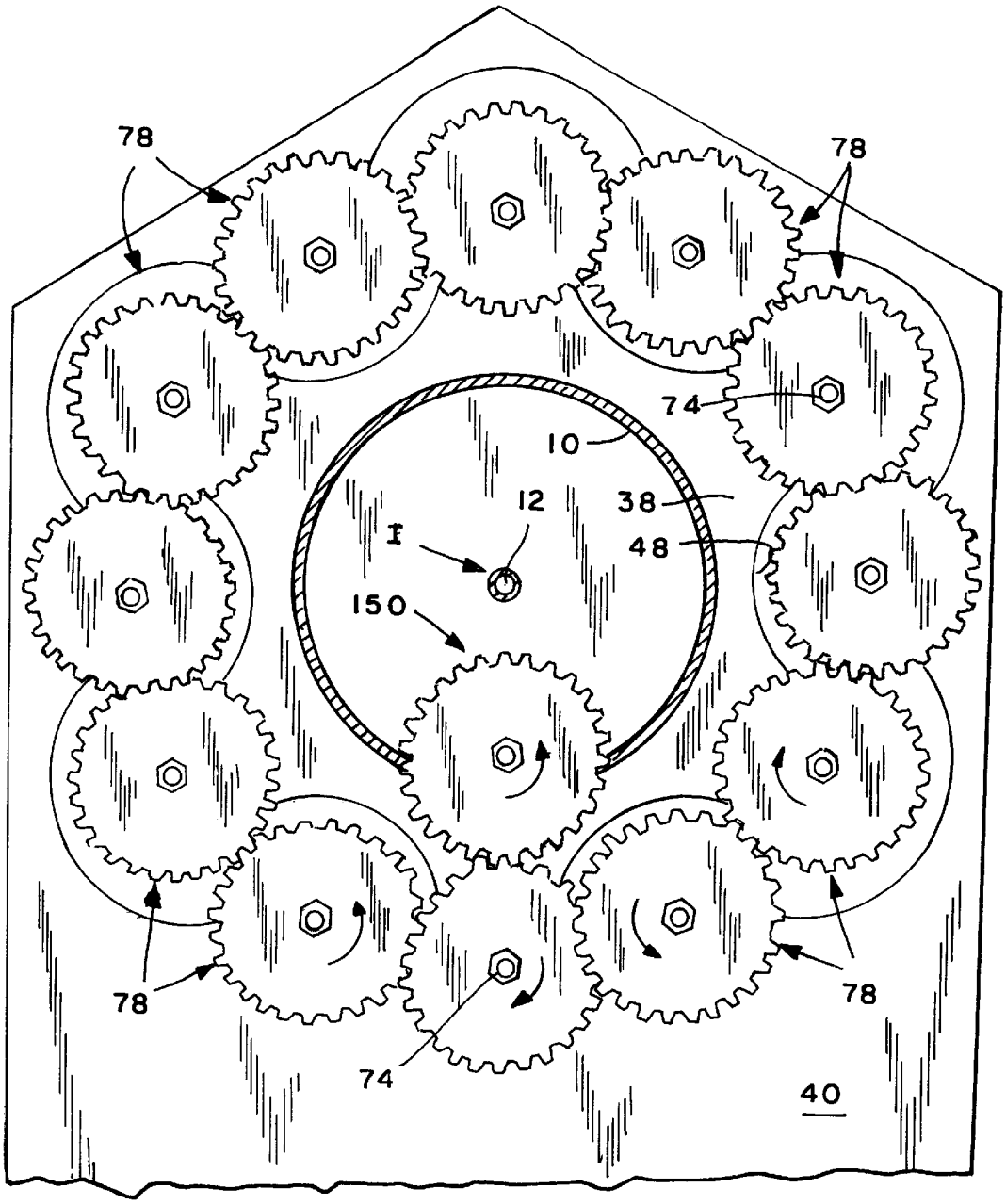
FIG. 12 is a vertical elevation view of the rotor gears for the drive arrangement.

FIG. 11 schematically illustrates rotors 76 mounted on the lobes of frame plate 38 and cam segments 42 of control cam 36 in the manner described hereinabove in connection with FIGS. 1 and 2, and schematically illustrates shuttles 32 alternately in the position of transfer between preceding and succeeding rotors with respect to the direction of path P and the position immediately following the transfer from the succeeding rotor to the next succeeding rotor in the direction of the path. FIG. 12 illustrates drive gears 78 of the rotor and drive gear units in meshing engagement with one another and with one of the gears 78 in meshing interengagement with a drive gear 150 which is shown as rotating counterclockwise, whereby the drive gear immediately driven thereby is rotated clockwise in FIG. 12. FIG. 12 is a view of the drive gears in the direction from left to right in FIG. 1, and the schematic illustration of FIG. 11 is with respect to viewing the rotors and shuttles in the direction from right to left in FIG. 1. The lowermost drive gear in FIG. 12 which is driven by gear 150 corresponds to the lowermost rotor 76 in FIG. 11, whereby the latter rotates counterclockwise in FIG. 11 and provides a counterclockwise direction for path P relative to braiding axis 12. In this respect, the intermeshing engagement between adjacent ones of the drive gears 78 imparts rotation to adjacent ones of the rotors in opposite directions relative to one another. In response to such rotation of the rotors, shuttle units 32 are transported along path P by the rotors and between transfer points at which a shuttle is transferred from a preceding to a succeeding rotor. Entrance ramps 60 and 62 and exit ramps 66 and 68 of the control cam come into play in connection with follower rollers 110 and 112 to control the position of escapement arm 104 of shuttle 32 relative to retaining rollers 98 of the rotors during the approach of the shuttle to the transfer point on the entrance side of segment of the control cam and during approach of the shuttle to the transfer point on the exit side of the segment. Control of the shuttle in this respect will be described in greater detail hereinafter.

Figure 13:
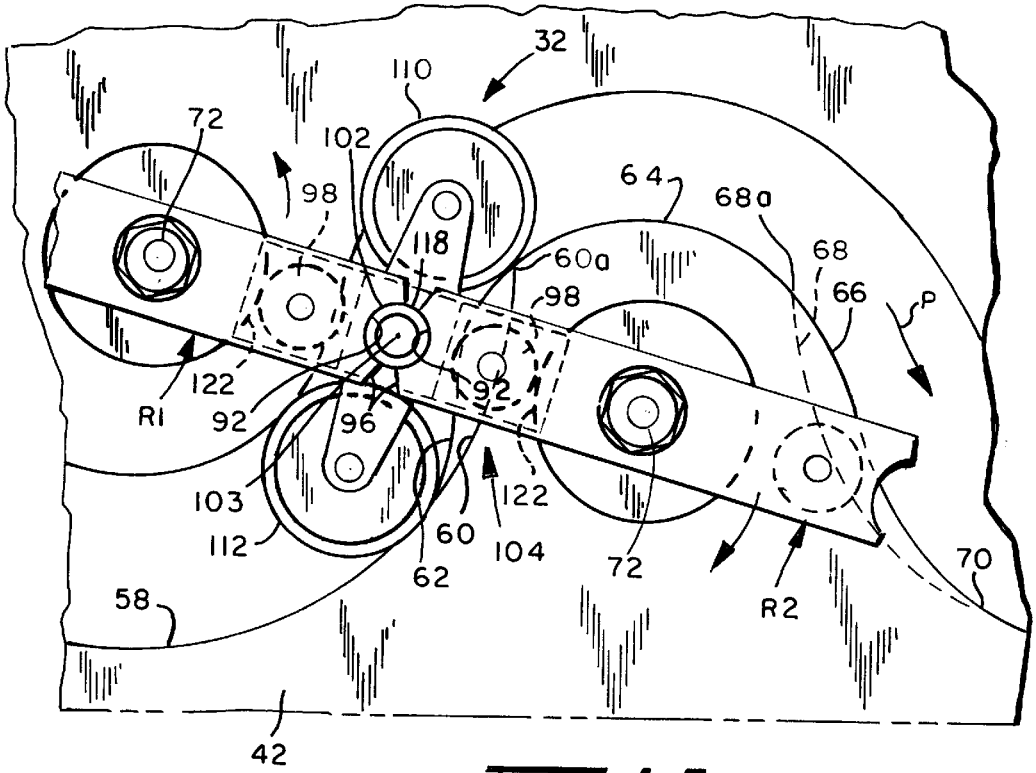
FIGS. 13, 14 and 15 sequentially show the movement of a shuttle between successive transfer points.
Figure 14:
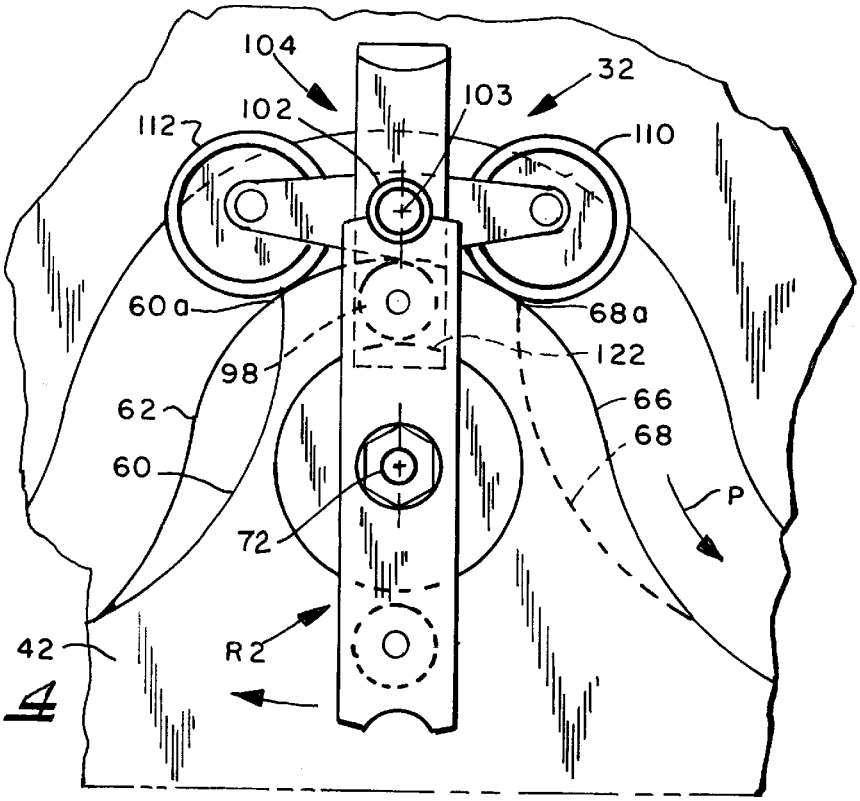
Figure 15:
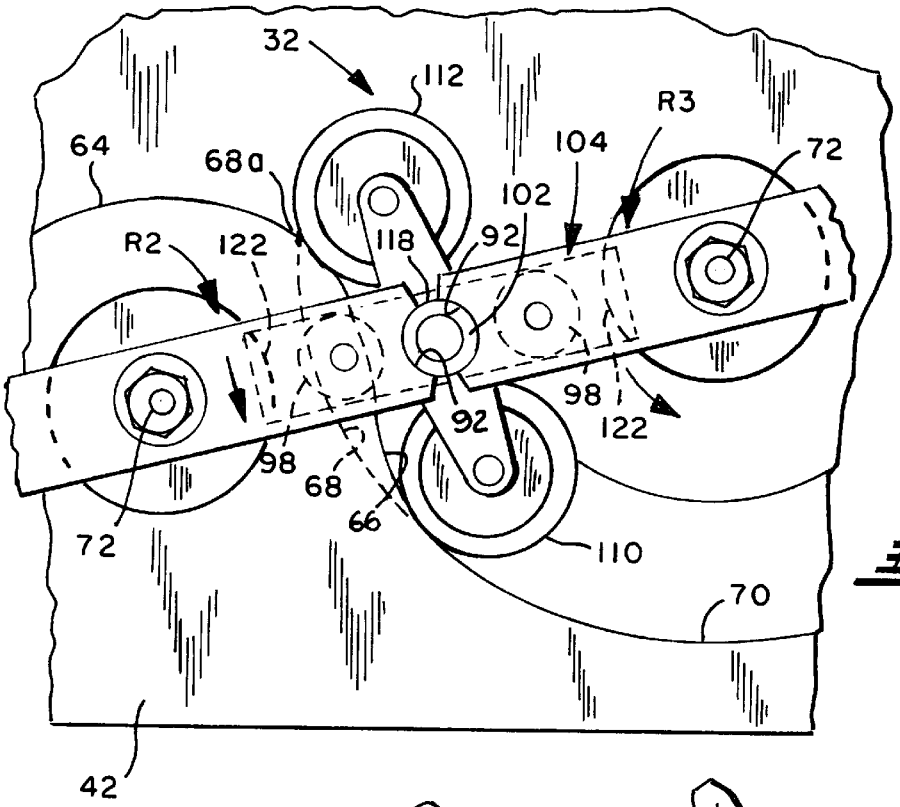

Transportation of the shuttle along path P between transfer points on the entrance and exit sides of a cam segment will be understood from FIGS. 11 and 13-15 and the following description thereof with reference to rotors R1, R2 and R3 and the shuttle 32 which is at the transfer point between rotors R1 and R2 and on the entrance side of a cam segment 42 in FIGS. 11 and 13. In the latter Figures, rotor R1 is the preceding rotor and R2 the succeeding rotor with respect to the direction of path P and with respect to the transfer of shuttle 32 therebetween. When shuttle 32 is at this transfer point, follower roller 110 has reached edge 60*a* of entrance ramp 60 and rotors R1 and R2 are substantially aligned relative to the axes of the drive shafts 72 thereof, whereby rotor engaging surface 118 of the shuttle is captured between opposed recesses 92 on the rotors. Further, escapement cam surfaces 122 on escapement arm 104 of the shuttle engage shuttle retaining rollers 98 on rotors R1 and R2, whereby the shuttle is stabilized with respect to rotor R1 and with respect to the transfer thereof to rotor R2. As will be appreciated from FIG. 13, follower roller 112 is in alignment with entrance ramp 62 whereby continued rotation of rotor R2 clockwise from the position shown in FIG. 13 results in shuttle 32 being interengaged with rotor R2 and moving therewith to the position shown in FIG. 14. Moreover, the shuttle is released from rotor R1 as rotor R2 moves clockwise and rotor R1 counterclockwise from the transfer point. In moving from the position shown in FIG. 13 to that shown in FIG. 14, shuttle 32 remains interengaged with rotor R2 by the uniform curvature of inlet ramp 62 and crest 64 of the cam track. As rotor R2 continues to rotate clockwise from the position shown in FIG. 14 to the position shown in FIG. 15, follower roller 110 engages exit ramp 66 as follower roller 112 moves along crest 64. Accordingly, shuttle 32 remains interengaged with rotor R2 because of the uniform curvature of ramp 64 and exit ramp 66 and, when rotors R2 and R3 reach the transfer point therebetween shown in FIG. 15, follower roller 112 is at entrance edge 68*a* of exit ramp 68. In connection with the approach to the transfer point on the exit side of the cam segment the clockwise rotation of rotor R2 and counterclockwise rotation of rotor R3 brings shuttle engaging surfaces 92 thereof into engagement with opposite sides of rotor engaging surface 118 on the shuttle. In connection with the approach and departure of shuttle 32 from the transfer points shown in FIGS. 13 and 15, the inclined end surfaces 96 on the rotors facilitate the relative displacement of the rotors through the transfer point without interfering engagement therebetween.

Figure 16:
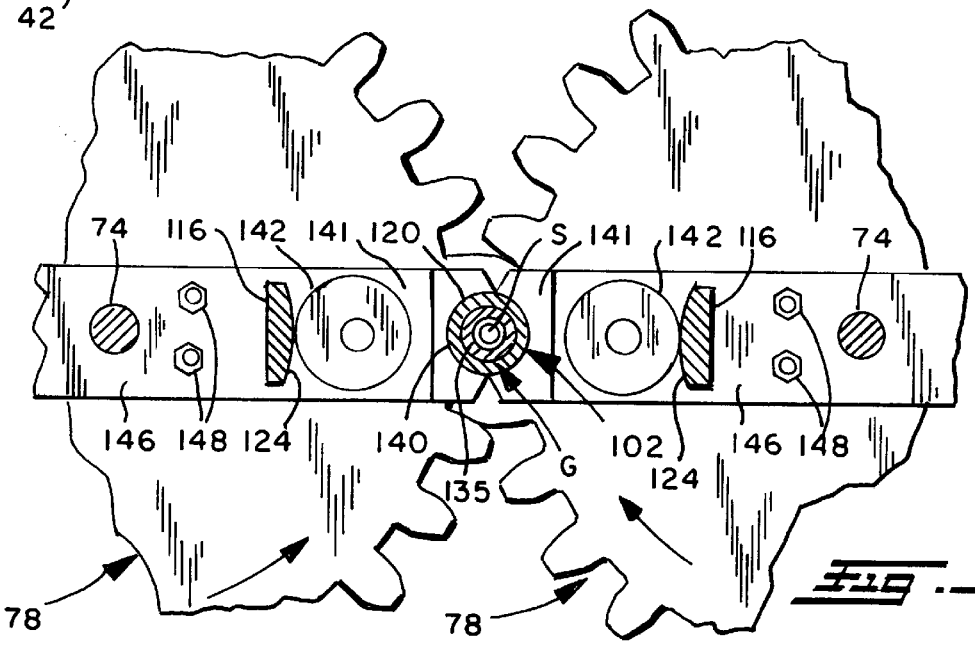
FIG. 16 is an elevation view in detail showing adjacent rotor drive gears and a shuttle interengaged therewith at the transfer point therebetween.
Figure 16A:
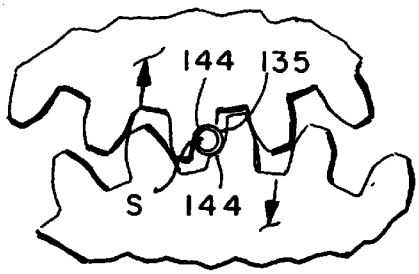
FIG. 16A is an elevation view in detail showing notches in teeth of adjacent drive gears for accommodating a strand guiding extension on the eyelet tubes.

When adjacent rotors are in the positions for transferring a shuttle therebetween, such as shown in FIG. 13 for example, the end of the shuttle adjacent the corresponding rotor drive gears 78 interengages with the latter as shown in FIGS. 16 and 16A of the drawing. More particularly in this respect, shuttle receiving recesses 140 on the gears receive drive gear engaging surface 120 of the shuttle and escapement cam surfaces 124 of escapement arm 106 of the shuttle interengage with shuttle retaining rollers 142 on the gears to support the shuttle and thus eyelet tube G during the transfer. FIG. 16 is looking at gears 78 in the direction from right to left in FIG. 1, whereby it will be appreciated with respect to FIG. 13 that the gears designated G1 and G2 in FIG. 16 correspond respectively to rotors R1 and R2. Furthermore, it will be appreciated from the foregoing description that when gears G1 and G2 rotate away from the position of transfer therebetween the shuttle remains interengaged with gear G2 through shuttle escapement cam surface 124 and the shuttle retaining roller 140 so as to rotate with the gear to the next transfer point. FIG. 16A is looking at gears 78 in the same direction as FIG. 16 but from behind arm 146 and rollers 142. Accordingly, as will be appreciated from FIGS. 7, 9 and 10 and the preceding description herein with respect thereto, the end of body member 102 on which escapement arm 106 is mounted, and the corresponding end of eyelet tube G terminate axially adjacent the front or outer side of drive gears 78, whereby the unthreaded portion of shank 135 of eyelet extension G1 extends across the teeth of the drive gear through the opposed recesses 144 in the teeth of adjacent ones of the drive gears which are aligned at the transfer point to provide a passageway thereacross for shank 135 and thus strand S as will be appreciated from FIG. 16A.

Figure 17:
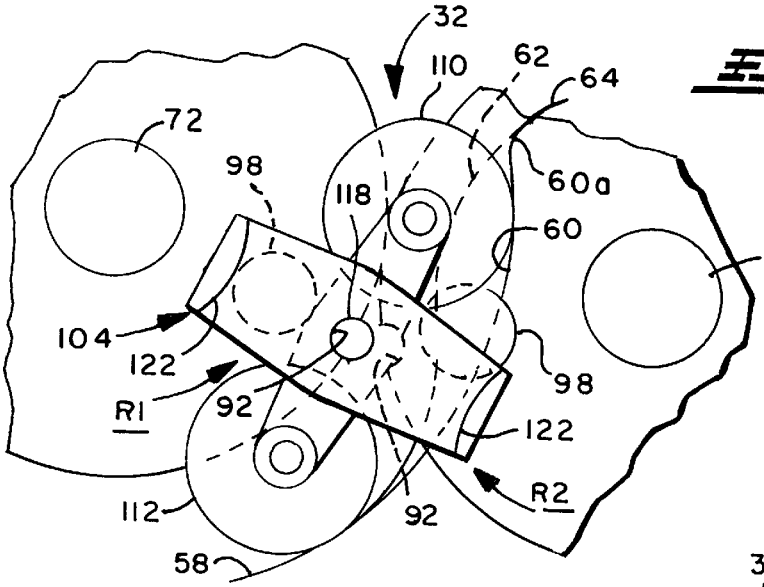
FIGS. 17–19 schematically illustrate the positional relationships between a shuttle and adjacent rotors as the preceding rotor with the shuttle interconnected therewith approaches the transfer point, reaches the transfer point and exits the transfer point with the shuttle interconnected with the succeeding rotor.
Figure 18:
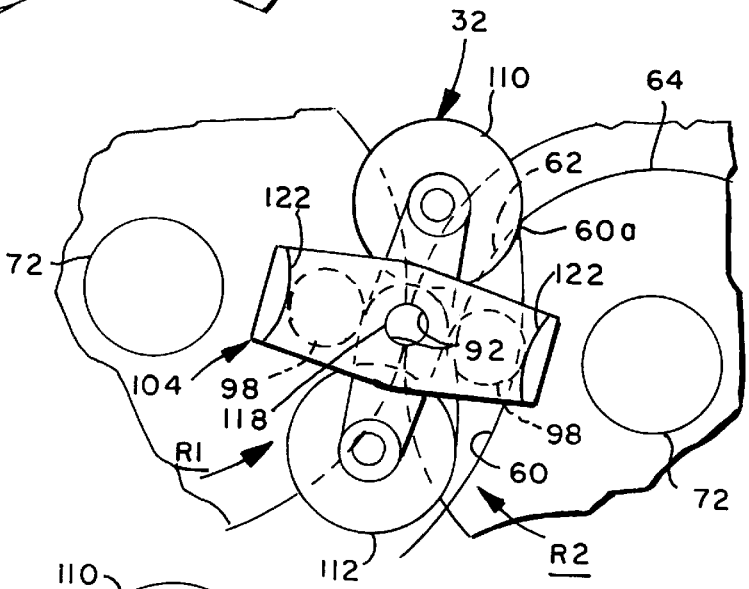
Figure 19:
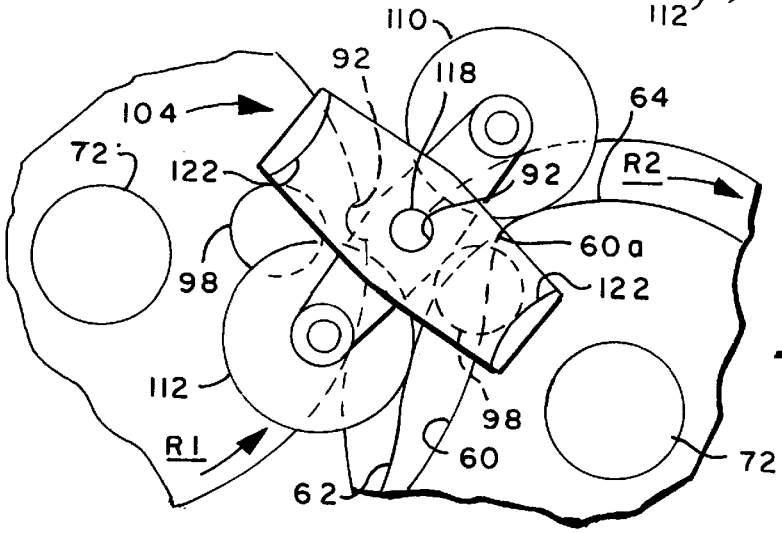

As mentioned above, entrance ramps 60 and 62 and exit ramps 66 and 68 operate in connection with follower rollers 110 and 112 to control the position of the escapement arm 104 of shuttle 32 relative to shuttle retaining rollers 98 of rotors 76 during the approach of shuttle 32 to the transfer point between preceding and succeeding rotors with respect to the direction of path P. Thus, in connection with the illustrations in FIGS. 13–15, entrance ramps 60 and 62 control the position of escapement arm 104 of shuttle 32 relative to retaining rollers 90 of rotor 92 as the shuttle approaches the transfer point between preceding rotor R1 and succeeding rotor R2. Similarly, exit ramp 66 and 68 control the position of escapement arm 104 of the shuttle relative to retaining rollers 98 and rotor R3 as the shuttle approaches the transfer point between preceding rotor R2 and succeeding rotor R3. More particularly in this respect, with reference to entrance ramps 60 and 62 FIGS. 17–19 of the drawing, FIG. 17 schematically illustrates the position of shuttle 32 as it approaches the transfer point shown in FIG. 13. In this position of the shuttle, rotor engaging surface 118 thereof is received in one of the shuttle receiving recesses 92 of rotor R1 and the shuttle is interengaged for movement with rotor R1 about the axis of its shaft 72 by the interengagement between one of the escapement cam surfaces 122 on escapement arm 104 of the shuttle and a shuttle retaining roller 98 on the rotor. As further mentioned hereinabove, entrance ramp 60 has the same radius of curvature relative to the axis of rotor R1 as does entrance end 58 of the cam segment on which rotor R2 is mounted, and entrance ramp 62 has the same radius of curvature relative to axis 72 of rotor R2 as does crest 64 of the cam surface. Thus, as will be appreciated from FIG. 17, follower roller 110 engages entrance ramp 60 of the cam and maintains the shuttle in the interengage position with rotor R1 for movement therewith toward the transfer point. Moreover, this position of the shuttle relative to rotor R1 and movement of roller 110 along ramp 60 allows movement of shuttle engaging recess 92 on rotor R2 and a shuttle retaining roller 98 thereon respectively into engagement with shuttle surface 118 and the other escapement cam surface 122 of escapement arm 104 of the shuttle when rotors R1 and R2 reach the transfer point therebetween shown in FIG. 13 and schematically in FIG. 18. At this point, follower roller 110 has reached exit edge 60*a* of entrance ramp 60 and follower roller 112 has moved onto the lower end of entrance ramp portion 62, whereby it will be appreciated that continued rotation of rotor R2 in the clockwise direction and rotor R1 in the counterclockwise direction provides for follower rollers 110 and 112 of shuttle 32 to engage crest 64 and entrance ramp 62, whereby the shuttle remains interengaged with rotor R2 for movement therewith about the axis thereof to the position shown in FIG. 14. Further in connection with such movement, as will be appreciated from FIG. 19, rotor engaging surface 118 of the shuttle is received in shuttle engaging recess 92 of rotor R2 and shuttle retaining roller 98 of the latter engages with an escapement cam surface 122 on escapement arm 104 of shuttle 32 to hold the shuttle engaging surface in recess 92. Further, as rotors R1 and R2 move away from the transfer point therebetween, the shuttle retaining roller 98 on rotor R1 disengages from escapement cam surface 122 with which it was previously engaged and the shuttle receiving recess 92 of rotor R1 moves out of engagement with rotor engaging surface 118 of the shuttle to release the shuttle for movement with rotor R2. As will be appreciated from the foregoing description with reference to FIGS. 17–19, when rotors R2 and R3 reach the transfer point therebetween shown in FIG. 15, follower roller 112 is at the entrance edge 68*a* of exit ramp 68, whereby continued rotation of rotor R3 counterclockwise and rotor R2 clockwise in FIG. 15 results in the follower roller 112 engaging exit ramp 68 which has the same radius of curvature relative to the axis of rotor R3 as exit end 70 of the cam segment, whereby shuttle 32 is released from rotor R2 and transferred to rotor R3 for movement therewith about the axis thereof to the next transfer point in the same manner as described hereinabove. As will likewise be appreciated from the foregoing description, the escapement arm 106 on the shuttle is controlled relative to shuttle retaining rollers 142 on drive gears 78 in the same manner as described above during movement of the shuttle to and through the transfer point between preceding and succeeding gears.

While considerable emphasis has been placed herein on a preferred embodiment of the invention, it will be appreciated that many changes can be made in the preferred embodiment and that other embodiments can be devised without departing from the principals of the invention. In particular in this respect, it will be appreciated that a cam track can be devised which would enable the shuttle to shift as necessary for the transfer thereof between adjacent rotors through the use of a single follower, such a cam track for example including radially inner and outer portions interengaging with the follower. Further, it will be appreciated that the followers in the preferred embodiment could be other than rollers, the latter being preferred for minimizing sliding frictional interengagement and wear between the component parts. These and other modifications of the preferred embodiment as well as other embodiments of the invention will be apparent and suggested from the foregoing description of the preferred embodiment, whereby it is to be distinctly understood that the descriptive matter herein is to be interpreted merely as illustrative of the present invention and not as a limitation.

Having thus described the invention, it is so claimed:

1. A machine for braiding strands of material in opposite directions about a braiding axis, said machine comprising a frame, means supporting a plurality of first strands of material on said frame for rotation in one direction about said braiding axis, means supporting a plurality of second strands of material on said frame for rotation about said braiding axis in the direction opposite said one direction, a plurality of rotors mounted on said frame for rotation about rotor axes spaced apart about said braiding axis, means for rotating adjacent ones of said rotors in opposite directions, a shuttle for each strand of at least one of the pluralities of first and second strands, each said shuttle having an axis parallel to said rotor axes, means for interengaging said rotors and said shuttles for said rotors to move said shuttles radially inwardly and outwardly relative to the other of the pluralities of first and second strands along a sinuous path about said braiding axis in the corresponding one of said one and opposite directions, a cam track extending about said braiding axis, and a follower on each shuttle for interengaging said shuttles and said cam track for transferring said shuttle between preceding and succeeding ones of said adjacent rotors with respect to the direction of said path.

2. A machine for braiding strands of material in opposite directions about a braiding axis, said machine comprising a frame, means supporting a plurality of first strands of material on said frame for rotation in one direction about said braiding axis, means supporting a plurality of second strands of material on said frame for rotation about said braiding axis in the direction opposite said one direction, a plurality of rotors mounted on said frame for rotation about rotor axes spaced apart about said braiding axis, means for rotating adjacent ones of said rotors in opposite directions, a shuttle for each strand of at least one of the pluralities of first and second strands, each said shuttle having an axis parallel to said rotor axes, means for interengaging said rotors and said shuttles for said rotors to move said shuttles radially inwardly and outwardly relative to the other of the pluralities of first and second strands along a sinuous path about said braiding axis in the corresponding one of said one and opposite directions, a cam track extending about said braiding axis, means interengaging said shuttles and said cam track for transferring a shuttle between preceding and succeeding ones of said adjacent rotors with respect to the direction of said path, said preceding and succeeding rotors having a shuttle transfer point therebetween and including shuttle retaining members, said shuttle including a plurality of escapement members, one escapement member on said shuttle engaging a retaining member on said preceding rotor upstream of said transfer point with respect to the direction of said path for said preceding rotor to move said shuttle toward said transfer point, and another escapement member on said shuttle engaging a retaining member on said succeeding rotor at said transfer point for said succeeding rotor to move said shuttle downstream of said transfer point.

3. The machine according to claim 2, wherein said one and said another escapement members on said shuttle respectively engage the retaining members on said preceding and succeeding rotors at said transfer point.

4. A machine for braiding strands of material in opposite directions about a braiding axis, said machine comprising a frame, means supporting a plurality of first strands of material on said frame for rotation in one direction about said braiding axis, means supporting a plurality of second strands of material on said frame for rotation about said braiding axis in the direction opposite said one direction, a plurality of rotors mounted on said frame for rotation about rotor axes spaced apart about said braiding axis, means for rotating adjacent ones of said rotors in opposite directions, a shuttle for each strand of at least one of the pluralities of first and second strands, each said shuttle having an axis parallel to said rotor axes, means for interengaging said rotors and said shuttles for said rotors to move said shuttles radially inwardly and outwardly relative to the other of the pluralities of first and second strands along a sinuous path about said braiding axis in the corresponding one of said one and opposite directions, a cam track extending about said braiding axis, means interengaging said shuttles and said cam track for transferring a shuttle between preceding and succeeding ones of said adjacent rotors with respect to the direction of said path, said preceding and succeeding rotors including shuttle retaining members and said shuttle including diametrically opposite first and second escapement members, said preceding and succeeding rotors having a shuttle transfer point therebetween, said first escapement member engaging the shuttle retaining member on said preceding rotor for said shuttle to move with said preceding rotor toward said transfer point, and said second escapement member engaging the shuttle retaining member on said succeeding rotor for said shuttle to move with said succeeding rotor away from said transfer point.

5. The machine according to claim 4, wherein said first and second escapement members simultaneously respectively engage said retaining members on said preceding and succeeding rotors during movement of said shuttle through said transfer point.

6. The machine according to claim 5, wherein said means for interengaging said shuttle and said cam track includes a follower on said shuttle engaging said cam track.

7. The machine according to claim 6, wherein said follower includes a pair of diametrically opposite follower rollers rotatable about axes parallel to said shuttle axis and in a plane orthogonal to the direction between said first and second escapement members.

8. The machine according to claim 7, wherein said cam track has first and second track portions of different contour at locations along said path corresponding to said transfer points, each track portion being engaged by a different one of said pair of follower rollers for controlling the transfer of said shuttle from said preceding to said succeeding rotor.

9. The machine according to claim 8, wherein said first and second track portions are axially offset from one another relative to said braiding axis.

10. A machine for braiding strands of material in opposite directions about a braiding axis, said machine comprising a frame, means supporting a plurality of first strands of material on said frame for rotation in one direction about said braiding axis, means supporting a plurality of second strands of material on said frame for rotation about said braiding axis in the direction opposite said one direction, a plurality of rotors mounted on said frame for rotation about rotor axes spaced apart about said braiding axis, means for rotating adjacent ones of said rotors in opposite directions, a shuttle for each strand of at least one of the pluralities of first and second strands, each said shuttle having an axis parallel to said rotor axes, means for interengaging said rotors and said shuttles for said rotors to move said shuttles radially inwardly and outwardly relative to the other of the pluralities of first and second strands along a sinuous path about said braiding axis in the corresponding one of said one and opposite directions, a cam track extending about said braiding axis, means interengaging said shuttles and said cam track for transferring a shuttle between preceding and succeeding ones of said adjacent rotors with respect to the direction of said path, said cam track including first and second cam tracks on said frame axially offset from one another and extending about said braiding axis, and said means interengaging said shuttles and said cam track including first and second followers on said shuttle respectively engaging said first and second cam tracks.

11. The machine according to claim 10, wherein said first and second followers include follower rollers rotatable about roller axes parallel to said shuttle axis and on diametrically opposite sides thereof.

12. The machine according to claim 10, wherein said preceding and succeeding rotors have a shuttle transfer point therebetween and include shuttle retaining members, said shuttle including a plurality of escapement members, one escapement member on said shuttle engaging a retaining member on said preceding rotor upstream of said transfer point with respect to the direction of said path for said preceding rotor to move said shuttle toward said transfer point, and another escapement member on said shuttle engaging a retaining member on said succeeding rotor at said transfer point for said succeeding rotor to move said shuttle downstream of said transfer point.

13. The machine according to claim 12, wherein said one and said another escapement members on said shuttle respectively engage the retaining members on said preceding and succeeding rotors at said transfer point.

14. The machine according to claim 13, wherein said first and second followers include follower rollers rotatable about roller axes parallel to said shuttle axis and on diametrically opposite sides thereof.

15. The machine according to claim 10, wherein said preceding and succeeding rotors includes shuttle retaining members and said shuttle includes diametrically opposite first and second escapement members, said preceding and succeeding rotors having a shuttle transfer point therebetween, said first escapement member engaging a retaining member on said preceding rotor for said shuttle to move with said preceding rotor toward said transfer point, said second escapement member engaging a retaining member on said succeeding rotor for said shuttle to move with said succeeding rotor away from said transfer point.

16. The machine according to claim 15, wherein said first and second escapement members simultaneously respectively engage said retaining members on said preceding and succeeding rotors during movement of said shuttle through said transfer point.

17. The machine according to claim 16, wherein said first and second followers include follower rollers rotatable about roller axes parallel to said shuttle axis and on diametrically opposite sides thereof.

18. A machine for braiding strands of material in opposite directions about a braiding axis, said machine comprising a frame, means supporting a plurality of first strands of material on said frame for rotation in one direction about said braiding axis, means supporting a plurality of second strands of material on said frame for rotation about said braiding axis in the direction opposite said one direction, a plurality of rotors mounted on said frame for rotation about rotor axes spaced apart about said braiding axis, means for rotating adjacent ones of said rotors in opposite directions, a shuttle for each strand of at least one of the pluralities of first and second strands, each said shuttle having an axis parallel to said rotor axes, means for interengaging said rotors and said shuttles for said rotors to move said shuttles radially inwardly and outwardly relative to the other of the pluralities of first and second strands along a sinuous path about said braiding axis in the corresponding one of said one and opposite directions, a cam track extending about said braiding axis, means interengaging said shuttles and said cam track for transferring a shuttle between preceding and succeeding ones of said adjacent rotors with respect to the direction of said path, said means for rotating adjacent one of said rotors in opposite directions including preceding and succeeding gears respectively on and coaxial with said preceding and succeeding ones of said rotors and in meshing engagement with one another, each said preceding and succeeding rotors and said preceding and succeeding gears having a shuttle transfer point therebetween, said preceding and succeeding rotors including first shuttle retaining members, said preceding and succeeding gears including second shuttle retaining members, and said shuttle including pluralities of first and second escapement members, one of said first escapement members and one of said second escapement members respectively engaging a first retaining member and a second retaining member for said preceding rotor to move said shuttle toward said transfer point, and another of said first escapement members and another of said second escapement members respectively engaging a first retaining member and a second retaining member for said succeeding rotor to move said shuttle away from said transfer point.

19. The machine according to claim 18, wherein said first and second shuttle retaining members are rollers having axes parallel to said rotor axes and said first and second escapement members are axially extending flanges.

20. The machine according to claim 18, wherein the first shuttle retaining members on each rotor are on diametrically opposite sides of the rotor axis and the second shuttle retaining members on each gear arc on diametrically opposite sides of the rotor axis.

21. The machine according to claim 20, wherein each of said first and second shuttle retaining members is a roller rotatable about a roller axis parallel to the rotor axis.

22. The machine according to claim 20, wherein said plurality of first and second escapement members respectively includes first and second pairs of axially extending flanges, the flanges of each pair being on diametrically opposite sides of said shuttle axis, and the first and second pairs being circumferentially aligned with respect to said shuttle axis.

23. The machine according to claim 22, wherein each of said first and second shuttle retaining members is a roller rotatable about a roller axis parallel to the rotor axis, the rotor axes lying in a common plane through said rotor axis.

24. In a machine for braiding strands of material in opposite directions about a braiding axis, said machine comprising a frame, means supporting a plurality of first strands of material on said frame for rotation in one direction about said braiding axis, means supporting a plurality of second strands of material on said frame for rotation about said braiding axis in the direction opposite said one direction, a plurality of rotors mounted on said frame for rotation about rotor axes spaced apart about said braiding axis, means for rotating adjacent ones of said rotors in opposite directions, a shuttle for each strand of at least one of the pluralities of first and second strands, each said shuttle having an axis parallel to said rotor axes, and means for interengaging said rotors and said shuttles for said rotors to move said shuttles radially inwardly and outwardly relative to the other of the pluralities of first and second strands along a sinuous path about said braiding axis in the corresponding one of said one and opposite directions, the improvement comprising: each said rotor having diametrically opposite shuttle engaging recesses with respect to the corresponding rotor axis and a shuttle retaining member radially inwardly of each recess, each said shuttle having a surface portion coaxial with the corresponding shuttle axis for engaging in a shuttle engaging recess of a rotor, and each said shuttle having escapement members on diametrically opposite sides of said shuttle axis, an escapement member on a given shuttle engaging with a shuttle in the recess of said given rotor for said given shuttle to rotate with said given rotor about the axis of said given rotor.

25. The improvement according to claim 24, wherein said surface portion of said shuttle is circular and said recesses are arcuate.

26. The improvement according to claim 24, wherein said shuttle retaining member is a roller rotatable about an axis parallel to the rotor axis and each said escapement member is a flange on said shuttle parallel to the shuttle axis.

27. The improvement according to claim 24, further including means for controlling the angular position of each said shuttle relative to preceding and succeeding ones of said adjacent rotors with respect to the direction of said path, said means for controlling the angular position of each said shuttle controlling the angular position of said given shuttle for said surface portion and one escapement member of said given shuttle to engage with a recess and shuttle retaining member of said preceding rotors for said preceding rotor to move said given shuttle toward said transfer point and for said surface portion and another escapement member of said given shuttle to engage with a recess and shuttle retaining member of said succeeding rotor for said succeeding rotor to move said given rotor away from said transfer point.

28. The improvement according to claim 27, wherein said means for controlling the angular position of each said shuttle includes cam track means extending about said braiding axis and follower means on each said shuttle engaging said cam track means.

29. The improvement according to claim 28, wherein said cam track means includes first and second cam tracks coaxial with said braiding axis, said follower means including first and second followers respectively engaging said first and second cam tracks.

30. The improvement according to claim 29, wherein said first and second cam tracks are axially adjacent one another and said first and second followers are axially offset and on diametrically opposite sides of said shuttle axis.

31. The improvement according to claim 30, wherein said first and second followers are follower rollers having axes parallel to said shuttle axis and in a plane orthogonal to the direction between the diametrically opposite escapement members on the shuttle.

32. The improvement according to claim 31, wherein said shuttle retaining member is a roller rotatable about an axis parallel to the rotor axis and each said escapement member is a flange on said shuttle parallel to the shuttle axis.

33. The improvement according to claim 32, wherein said surface portion of said shuttle is circular and said recesses are arcuate.

34. The improvement according to claim 24, wherein said means for rotating adjacent ones of said rotors in opposite directions includes gears on and coaxial with said adjacent rotators and in meshing engagement with one another, each said gear having diametrically opposite shuttle engaging recesses with respect to the corresponding rotor axis and a shuttle retaining element radially inwardly of each recess, and each said shuttle having a second surface portion coaxial with the corresponding shuttle axis for engaging in a shuttle engaging recess of a gear and second escapement members on diametrically opposite sides of said shuttle axis, a second escapement member on said given shuttle engaging with a shuttle retaining element on the gear on said given rotor to engage said second surface portion of said given shuttle in the recess of the gear on said given rotor when said given shuttle rotates with said given rotor about the axis of said given rotor.

35. The improvement according to claim 34, wherein each said shuttle retaining member and shuttle retaining element is a roller rotatable about an axis parallel to the rotor axis and each said escapement member and second escapement member is a flange on said shuttle parallel to the shuttle axis.

36. A braiding machine comprising a frame, a plurality of rotors on said frame and rotatable about rotor axes arranged about a braiding axis, means for rotating adjacent ones of said rotors in opposite directions, a strand shuttle having a shuttle axis, means interengaging said rotors and said shuttle for said rotors to move said shuttle along a sinuous path in a given direction about said braiding axis, said adjacent ones of said rotors having transfer points for sequentially transferring said shuttle from a preceding rotor to a succeeding rotor with respect to said given direction, said means interengaging said rotors and said shuttle including a first retaining member on said preceding rotor interengaging with a first escapement member on said shuttle for movement of said shuttle with said preceding rotor toward the transfer point between said preceding and succeeding rotors, and a second retaining member on said succeeding rotor interengaging with a second escapement member on said shuttle at said transfer point between said preceding and succeeding rotors for said shuttle to move with said succeeding rotor away from said transfer point between said preceding and succeeding rotors, a shuttle cam on said frame extending about said braiding axis and a cam follower on said shuttle engaging said shuttle cam for controlling the angular position of said shuttle relative to said preceding and succeeding rotors for disengaging said first retaining member and said first escapement member and engaging said second retaining member and second escapement member as said preceding and succeeding rotors move said shuttle through the transfer point therebetween.

* * * * *